US007438600B1

(12) United States Patent
Hung et al.

(10) Patent No.: US 7,438,600 B1
(45) Date of Patent: Oct. 21, 2008

(54) MEMORY CARD CONNECTOR

(75) Inventors: Pei-Chiao Hung, Taipei Hsien (TW); Mei-Chuan Yang, Taipei Hsien (TW)

(73) Assignee: Cheng Uei Precision Industry Co., Ltd., Taipei Hsien (TW)

( * ) Notice: Subject to any disclaimer, the term of this patent is extended or adjusted under 35 U.S.C. 154(b) by 0 days.

(21) Appl. No.: 11/924,311

(22) Filed: Oct. 25, 2007

(51) Int. Cl.
*H01R 24/00* (2006.01)

(52) U.S. Cl. ..... 439/630; 439/521; 439/608

(58) Field of Classification Search ..... 439/521, 439/630, 608
See application file for complete search history.

(56) References Cited

U.S. PATENT DOCUMENTS 6,095,868 A * 8/2000 Hyland et al. ..... 439/630
6,544,074 B2 * 4/2003 Bricaud et al. ..... 439/630
6,623,304 B2 * 9/2003 Harasawa et al. ..... 439/630
7,220,148 B2 * 5/2007 Zhao et al. ..... 439/630

* cited by examiner

*Primary Examiner*—Truc T Nguyen
(74) *Attorney, Agent, or Firm*—WPAT, P.C.; Anthony King

(57) ABSTRACT

A memory card connector includes an insulating housing defining conductive terminal grooves and a switch terminal groove. A metallic shell coupling with the insulating housing to form a card cavity therebetween has a top section and two side sections. The front of a top surface of one side section extends and inclines to the front of the top section to form an anti-mismating portion connecting with the front of the top section to form an inclined corner at the front of the metallic shell. One side section extends rearward to form a touching portion protruding toward the inner of the card cavity. Conductive terminals received in the conductive terminal grooves have a base portion, a soldering portion and a contacting portion. A switch terminal assembled in the switch terminal groove has a main body extending rearward to form a resilient arm received in the card cavity. The resilient arm defines a contacting projection facing the touching portion and a pressing portion facing the inner of the card cavity.

5 Claims, 4 Drawing Sheets

MEMORY CARD CONNECTOR

BACKGROUND OF THE INVENTION

1. Field of the Invention

The present invention relates generally to a memory card connector, and more particularly to a memory card connector having an anti-mismating portion to prevent incorrect insertion of a memory card.

2. The Related Art

Recently, electronic devices, such as digital cameras, MP3 players, cellular phones, etc., are required with larger capacity of storage to store data. A memory card, such as a Memory Stick Duo card, a SD card, a Mini SD card, a MMC card, a M2 card, etc., which has larger capacity of storage and a small size, is extensively used to expend the capacity of storage of the electronic devices. The data transmission between the electronic device and the memory card is through a memory card connector mounted on a PCB (printed circuit board) of the electronic device for connecting with the memory card. The memory card connector has an insulating housing. The insulating housing includes a receiving cavity for receiving the memory card and a plurality of grooves for respectively receiving a plurality of terminals. One end of the terminal forms a soldering portion for being soldered to the PCB, and the other end of each terminal forms a connecting portion for mating with the memory card. A metallic cover couples with the insulating housing. The memory card is inserted and held in the receiving cavity of the memory card connector for being used in storing various data and taken by the electronic device as a recording medium. If not in use, the inserted memory card can be pulled out from the receiving cavity of the memory card connector.

However, the memory card connector described above has no structure to prevent incorrect insertion therein of the memory card. Once the memory card is inserted into the memory card connector in a wrong way, the terminals of the memory card connector are crushed and broken. Therefore, the connection between the memory card and the memory card connector is susceptible to being interrupted, resulting in unstable signal transmission between the memory card and the memory card connector.

SUMMARY OF THE INVENTION

Accordingly, an object of the present invention is to provide a memory card connector having an anti-mismating portion to prevent incorrect insertion of a memory card.

To achieve the object described above, the memory card connector includes an insulating housing having a front wall, a rear wall, two sidewalls, a bottom wall and a top wall. The insulating housing defines conductive terminal grooves and a switch terminal groove at a side thereof. A metallic shell coupling with the insulating housing to form a card cavity therebetween has a top section and two side sections extending downward from both sides of the top section respectively. The front of a top surface of one side section extends and inclines to the front of the top section to form an anti-mismating portion connecting with the front of the top section to form an inclined corner at the front of the metallic shell. One side section extends rearward from a rear surface thereof to form a touching portion protruding toward the inner of the card cavity. Conductive terminals have a base portion fixed in the conductive terminal groove. An end of the base portion protrudes to form a soldering portion soldered to a printed circuit board. The other end of the base portion extends frontward and then extends backward to form a contacting portion for engaging with a corresponding contact of the memory card inserted into the card cavity. And a switch terminal assembled in the switch terminal groove of the insulating housing has a main body. The main body extends rearward to form a resilient arm received in the card cavity. A contacting projection is defined on the resilient arm and faces the touching portion of the metallic shell. A rear end of the resilient arm protrudes toward the inner of the card cavity to form a pressing portion for being pressed outward by the memory card fully inserted into the card cavity, which causes the contacting projection to electrically contact the touching portion for grounding and electrically connecting with the printed circuit board.

As described above, the anti-mismating portion is designed in accordance with the industry standard of the memory card, which ensures that the memory card is inserted into the card cavity in a correct way. The memory card connector has a simple structure and is easy to be assembled and manufactured. In addition, whether the contacting projection of the switch terminal electrically contacts the touching portion of the metallic shell or not indicates that the memory card is fully inserted into the memory card connector or not, ensuring the signal transmission between the memory card and the memory card connector to be stable.

BRIEF DESCRIPTION OF THE DRAWINGS

The present invention will be apparent to those skilled in the art by reading the following description of a preferred embodiment thereof, with reference to the attached drawings, in which.

DETAILED DESCRIPTION OF THE PREFERRED EMBODIMENT

Figure 1:
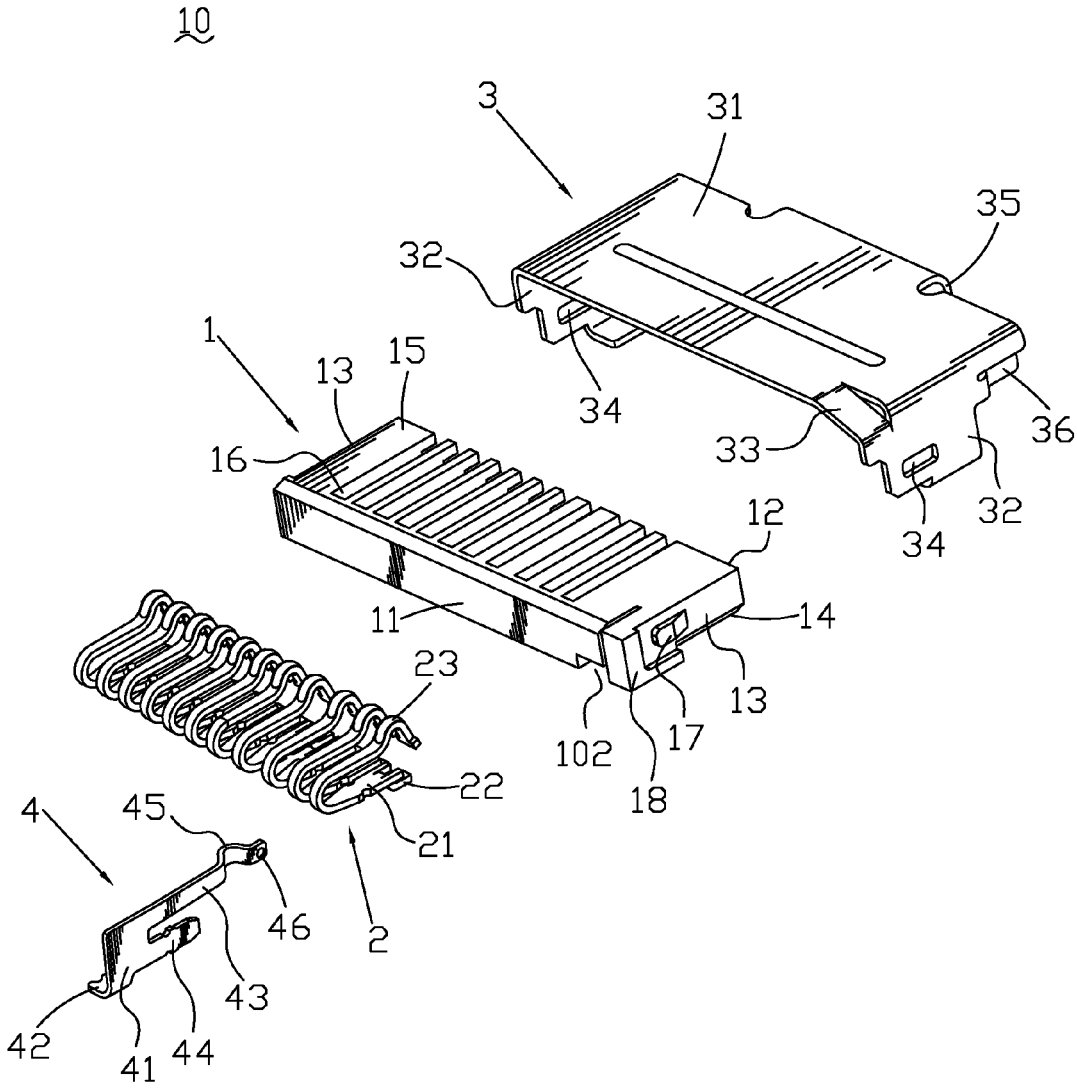
FIG. 1 is an exploded view of a memory card connector of the present invention.
Figure 3:
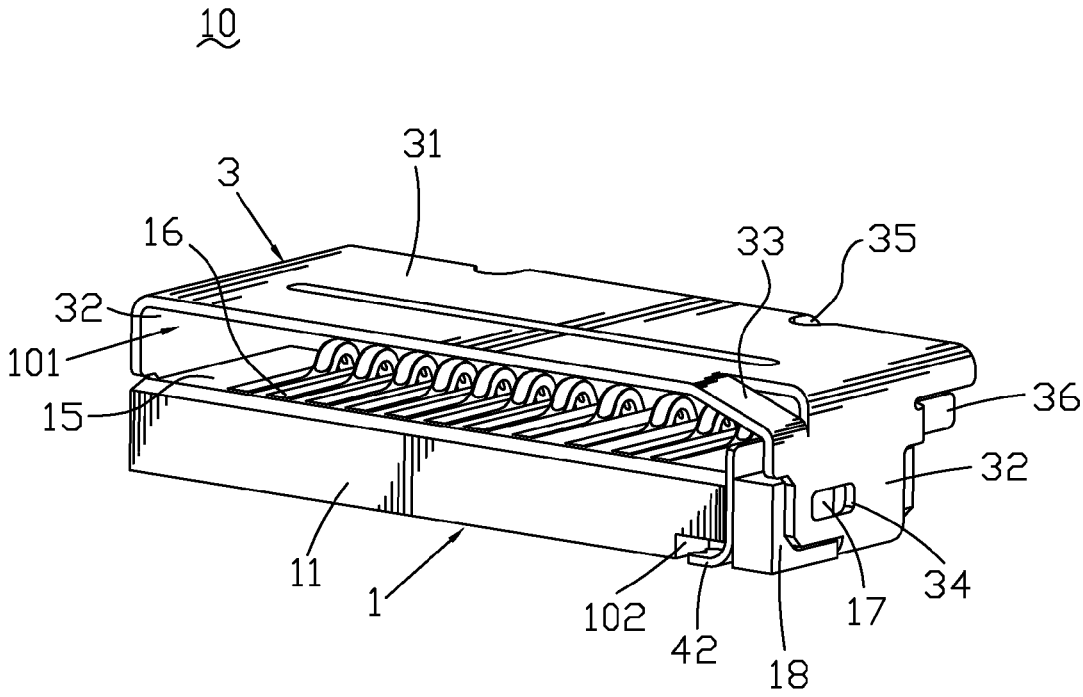
FIG. 3 is a perspective view of the memory card connector.

Referring to FIG. 1 and FIG. 3, a memory card connector 10 mountable on a printed circuit board (not shown) and electrically connecting with a memory card (shown in FIG. 5) includes an insulating housing 1, a plurality of conductive terminals 2 received in the insulating housing 1 respectively, a metallic shell 3 coupling with the insulating housing 1 to form a card cavity 101 therebetween for receiving the memory card therein, and a switch terminal 4 received in the insulating housing 1. In a preferred embodiment of the present invention, the memory card is a Memory Stick Micro Card 20 which will be called M2 card for short in the following description.

Please refer to FIG. 1. The insulating housing 1 is substantially rectangular and disposed transversely. The insulating housing 1 has a front wall 11, a rear wall 12, two sidewalls 13, a bottom wall 14 and a top wall 15. The insulating housing 1 longitudinally defines a plurality of conductive terminal grooves 16 in a side-by-side row and passing through the top wall 15, the bottom wall 14 and the rear wall 12. Each of the sidewalls 13 protrudes outward to form a locking bump 17 and an L-shaped supporting block 18. A vertical portion of the supporting block 18 is adjacent to the front wall 11 and a longitudinal portion of the supporting block 18 is adjacent to the bottom wall 14. A switch terminal groove 102 is longitudinally defined in a sidewall 13 passing through the corresponding front wall 11, the front of the top wall 15 and the front of the bottom wall 14.

The conductive terminal 2 has a base portion 21 fixed in the conductive terminal groove 16. A rear end of the base portion 21 protrudes downward to form a soldering portion 22 parallel with a bottom surface of the bottom wall 14 for being soldered to the printed circuit board. The other end of the base portion 21 extends frontward and then extends backward to form a contacting portion 23. The contacting portion 23 tilts upward a bit and is raised into the card cavity 101 for engaging with a corresponding contact of the M2 card 20 inserted into the card cavity 101.

Please refer to FIG. 1 and FIG. 3 again. The switch terminal 4 assembled in the switch terminal groove 102 of the insulating housing 1 is sheet-shaped and disposed vertically. The switch terminal 4 has a main body 41. A bottom surface of the main body 41 extends toward one side thereof to form a second soldering portion 42 soldered to the printed circuit board. A substantial middle of a rear surface of the main body 41 extends rearward to define a locating arm 44 fixedly disposed in the switch terminal groove 102. A top surface of the main body 41 extends rearward to form a resilient arm 43 above and parallel with the locating arm 44. The resilient arm 43 is placed on the top wall 15 of the insulating housing 1. A rear end of the resilient arm 43 protrudes to form a pressing portion 45 facing the inner of the card cavity 101 for being pressed outward by the M2 card 20 fully inserted into the card cavity 101. A substantially circular contacting projection 46 is defined on the rear end of the resilient arm 43, which is adjacent to and behind the pressing portion 45.

Figure 2:
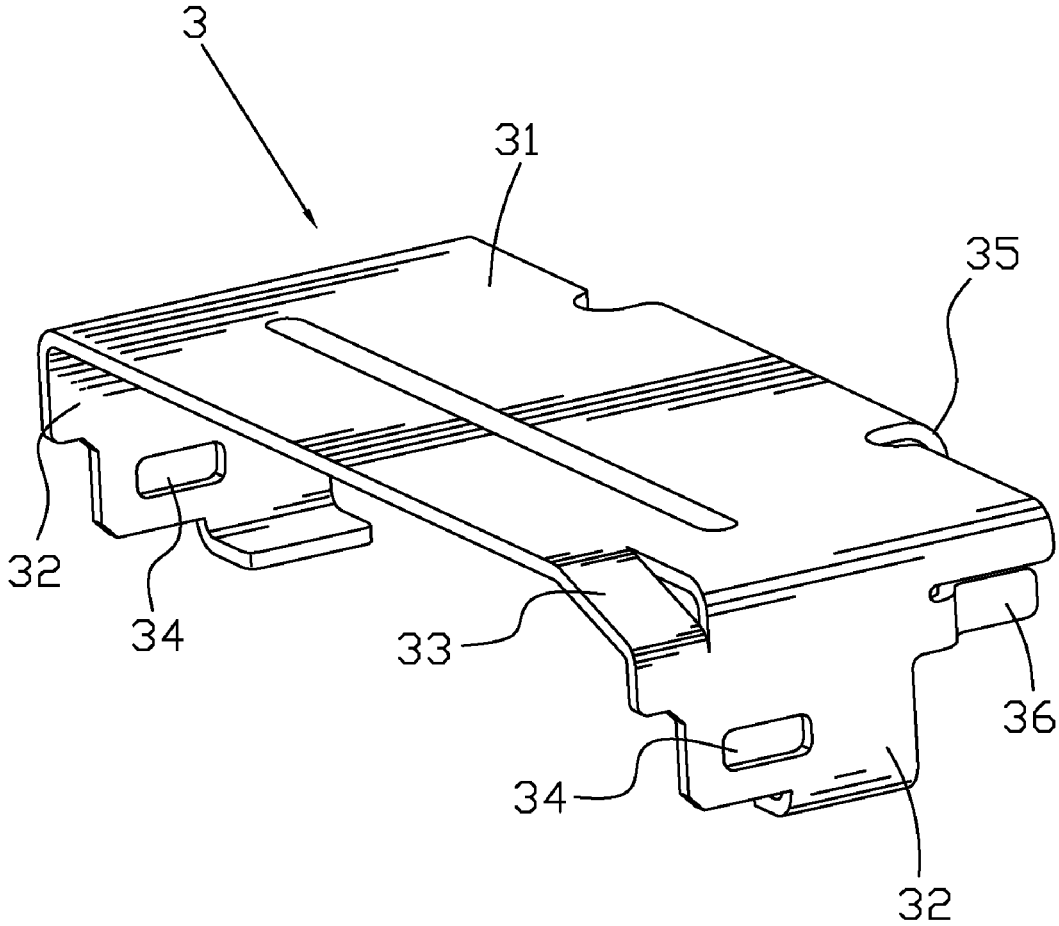
FIG. 2 is a perspective view of a metallic shell of the memory card connector.
Figure 4:
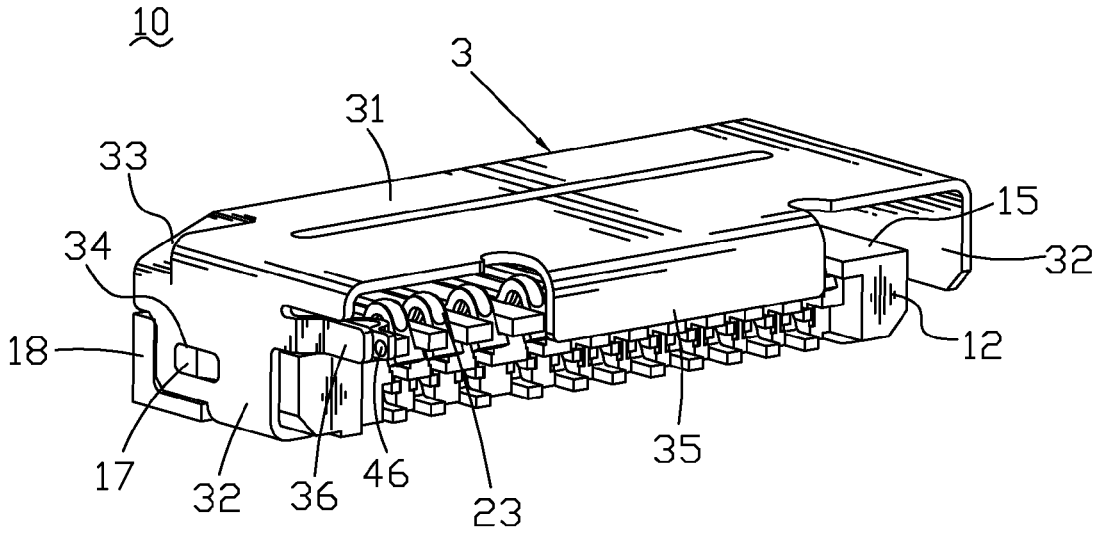
FIG. 4 is another perspective view of the memory card connector.

With reference to FIG. 2 and FIG. 4, the metallic shell 3 has a top section 31 disposed above the top wall 15 of the insulating housing 1. Two side sections 32 extend downward from both sides of the top section 31 respectively. The two side sections 32 define a locating hole 34 thereon. The two side sections 32 are engaged with the two sidewalls 13 of the insulating housing 1 respectively and supported via the supporting blocks 18. The locating holes 34 receive the locking bumps 17 therein for fixedly assembling the metallic shell 3 with the insulating housing 1. The front of a top surface of one side section 32 extends and inclines to the front of the top section 31 to form an anti-mismating portion 33. The anti-mismating portion 33 connects with the front of the top section 31 to form an inclined corner at the front of the metallic shell 3. Therefore, the height and the width from the metallic shell 3 to the top wall 15 of the insulating housing 1 are decided, which fittingly mate with the structure of the M2 card 20 designed in a stepped shape at a side thereof. A rear surface of one side section 32 extends rearward a bit and then bends toward the inner of the card cavity 101 and then extends rearward to form a stepped touching portion 36 adjacent to the top section 31. The touching portion 36 has a distance from the contacting projection 46 of the switch terminal 4 without the M2 card 20 fully inserted into the card cavity 101. The middle of a rear surface of the top section 31 extends downward to define a preventing section 35 for avoiding the M2 card 20 inserted overly.

Figure 5:
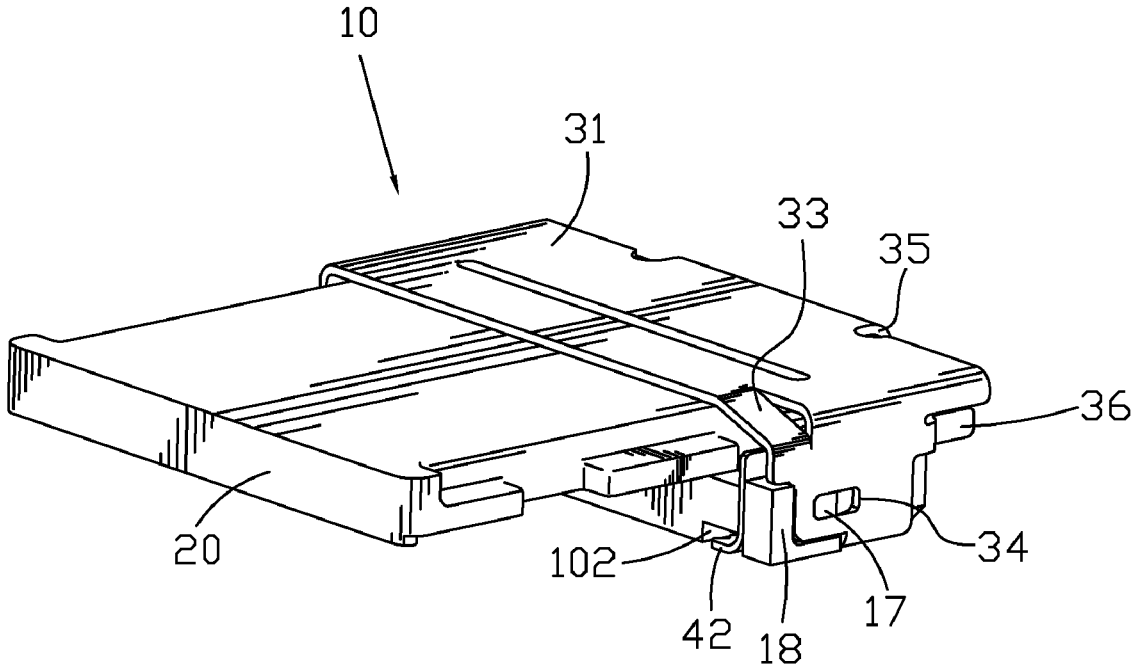
FIG. 5 is a perspective view of the memory card connector receiving a memory card therein.

Please refer to FIG. 5 together with FIG. 4. The contacting projection 46 of the switch terminal 4 and the touching portion 36 of the metallic shell 3 keep a distance from each other before the M2 card 20 is inserted in the card cavity 101. While the M2 card 20 is partially inserted in the card cavity 101 in a correct way, the contacts of the M2 card 20 respectively engage with the contacting portions 23 of the conductive terminals 2 firstly. Then the M2 card 20 is inserted toward the inner of the card cavity 101 continually. After the M2 card 20 is fully inserted into the card cavity 101, the side of the M2 card 20 compresses the pressing portion 45 of the switch terminal 4 to cause the contacting projection 46 to move toward the touching portion 36 of the metallic shell 3 and electrically contact the touching portion 36 for grounding. Therefore, a circuit disposed on the printed circuit board detects that the contacting projection 46 electrically contacts to the touching portion 36 for grounding, and then drives the M2 card 20 storing or reading data.

When the M2 card 20 is inserted in the card cavity 101 in an incorrect way, because of the industry standard of the M2 card 20 and thereby the M2 card 20 having a special structure and special dimensions, the anti-mismating portion 33 prevents the M2 card 20 from being inserted into the card cavity 101, which avoids the conductive terminals 2 being broken by the M2 card 20 incorrectly inserted into the card cavity 101.

As described above, the anti-mismating portion 33 is designed in accordance with the industry standard of the memory card, which ensures that the memory card is inserted into the card cavity 101 in the correct way. The memory card connector 10 has a simple structure and is easy to be assembled and manufactured. In addition, whether the contacting projection 46 of the switch terminal 4 electrically contacts the touching portion 36 of the metallic shell 3 or not indicates that the M2 card 20 is fully inserted into the memory card connector 10 or not, ensuring the signal transmission between the M2 card 20 and the memory card connector 10 to be stable.

The foregoing description of the present invention has been presented for purposes of illustration and description. It is not intended to be exhaustive or to limit the invention to the precise form disclosed, and obviously many modifications and variations are possible in light of the above teaching. Such modifications and variations that may be apparent to those skilled in the art are intended to be included within the scope of this invention as defined by the accompanying claims.

What is claimed is:

1. A memory card connector, comprising:

an insulating housing, having a front wall, a rear wall, two sidewalls, a bottom wall and a top wall, the insulating housing defining conductive terminal grooves and a switch terminal groove at a side thereof;

a metallic shell, coupling with the insulating housing to form a card cavity therebetween, the metallic shell having a top section and two side sections extending downward from both sides of the top section respectively, the front of a top surface of one side section extending and inclining to the front of the top section to form an anti-mismating portion which connects with the front of the top section to form an inclined corner at the front of the metallic shell, one side section extending rearward from a rear surface thereof to form a touching portion protruding toward the inner of the card cavity;

conductive terminals, having a base portion fixed in the conductive terminal groove, an end of the base portion protruding to form a soldering portion soldered to a printed circuit board, the other end of the base portion extending frontward and then extending backward to form a contacting portion for engaging with a corresponding contact of a memory card inserted into the card cavity; and a switch terminal, assembled in the switch terminal groove of the insulating housing, having a main body, the main body extending rearward to form a resilient arm received in the card cavity, a contacting projection defined on the resilient arm and facing the touching portion of the metallic shell, a rear end of the resilient arm protruding toward the inner of the card cavity to form a pressing portion for being pressed outward by the memory card fully inserted into the card cavity, which causes the contacting projection to electrically contact the touching portion for grounding and connecting with the printed circuit board.

2. The memory card connector as claimed in claim 1, wherein the two sidewalls of the insulating housing respectively protrude outward to form a locking bump, the two side sections of the metallic shell define a locating hole, the locking bumps are received in the locating holes for fixedly assembling the metallic shell with the insulating housing.

3. The memory card connector as claimed in claim 1, wherein the top section of the metallic shell extends downward from the middle of a rear surface thereof to define a preventing section for avoiding the memory card inserted overly.

4. The memory card connector as claimed in claim 1, wherein the sidewalls of the insulating housing protrude outward to form an L-shaped supporting block, a vertical portion of the supporting block is adjacent to the front wall and a longitudinal portion of the supporting block is adjacent to the bottom wall for supporting the side sections of the metallic shell.

5. The memory card connector as claimed in claim 1, wherein the main body of the switch terminal extends toward one side thereof to form a second soldering portion soldered to the printed circuit board at a bottom surface thereof, a rear surface of the main body extends rearward to define a locating arm beneath the resilient arm and fixedly disposed in the switch terminal groove.

* * * * *